US007594651B2

(12) United States Patent
Hall et al.

(10) Patent No.: US 7,594,651 B2
(45) Date of Patent: Sep. 29, 2009

(54) MEDIA FEED SYSTEM AND METHOD

(75) Inventors: Jeffrey D. Hall, Meridian, ID (US); C. Troy Jensen, Caldwell, ID (US); Donald K. Wadley, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 678 days.

(21) Appl. No.: 10/454,262

(22) Filed: Jun. 3, 2003

(65) Prior Publication Data

US 2004/0245704 A1 Dec. 9, 2004

(51) Int. Cl.
*B65H 3/06* (2006.01)

(52) U.S. Cl. ..... 271/117; 271/124; 271/125

(58) Field of Classification Search ..... 271/117, 271/124, 125, 274
See application file for complete search history.

(56) References Cited

U.S. PATENT DOCUMENTS

| | | | | |
|---|---|---|---|---|
| 2,192,414 | A * | 3/1940 | Reed | 271/274 |
| 4,288,068 | A * | 9/1981 | Hashimoto et al. | 271/125 |
| 4,662,816 | A * | 5/1987 | Fabrig | 414/801 |
| 5,210,616 | A * | 5/1993 | Kawasaki et al. | 358/296 |
| 5,245,886 | A * | 9/1993 | Truesdell et al. | 74/501.6 |
| 5,435,540 | A * | 7/1995 | Martin et al. | 271/122 |
| 5,462,267 | A * | 10/1995 | Hori | 271/10.04 |
| 5,511,774 | A * | 4/1996 | Lyga | 271/273 |
| 5,651,542 | A * | 7/1997 | Yamauchi et al. | 271/122 |
| 5,927,703 | A * | 7/1999 | Endo | 271/10.03 |
| 6,002,891 | A * | 12/1999 | Shin | 399/45 |
| 6,209,862 | B1 | 4/2001 | Kelley | |
| 6,352,256 | B1 | 3/2002 | Hsieh | |
| 6,382,619 | B1 | 5/2002 | Gustafson et al. | |
| 6,389,242 | B1 * | 5/2002 | Watanabe | 399/45 |
| 6,390,464 | B1 | 5/2002 | Gutierrez et al. | |
| 6,503,010 | B2 | 1/2003 | Jeong | |
| 6,526,241 | B1 * | 2/2003 | Kishi et al. | 399/81 |
| 6,578,842 | B2 * | 6/2003 | Hoberock | 271/117 |
| 6,676,313 | B1 * | 1/2004 | Kelley et al. | 400/582 |
| 6,734,417 | B2 * | 5/2004 | Vejtasa | 250/231.13 |
| 6,788,440 | B1 * | 9/2004 | Sashida | 358/498 |
| 2001/0020765 | A1 * | 9/2001 | Araki et al. | 271/125 |
| 2003/0132568 | A1 * | 7/2003 | Garcia et al. | 271/38 |

FOREIGN PATENT DOCUMENTS

| | | | |
|---|---|---|---|
| GB | 2053858 | * | 2/1981 |

* cited by examiner

*Primary Examiner*—Patrick H Mackey
*Assistant Examiner*—Thomas A Morrison

(57) ABSTRACT

A media feed system includes a roller and a selectively adjustable biasing system operatively connected to the roller, wherein the adjustable biasing system includes a spring coupled to an adjustable mount, the mount being movable to compress or decompress the spring.

12 Claims, 7 Drawing Sheets

MEDIA FEED SYSTEM AND METHOD

BACKGROUND

Printing and scanning apparatuses such as printers, scanners, copiers, and facsimile machines typically include automatic media feed systems. Automatic media feed systems introduce blank media, such as sheets of paper, into a printer or copier so that an image can be printed or reproduced on the media. Recently, individual printing and scanning apparatuses have been designed to perform multiple functions and handle various types of print media without interruption.

While modern printing and scanning apparatuses are often capable of scanning and printing multiple media types, it is common for the printing and scanning systems to require manual handling when media changes are required. The variety of media regularly used with such apparatuses includes labels, transparencies, and paper of various types and weights. Some specialized printers even accept objects such as optical discs (e.g. CDs and DVDs) for printing purposes.

FIG. 1 illustrates a typical a feed mechanism (100) used to supply media to a printing or scanning apparatus. As shown in FIG. 1, a typical feed mechanism (100) includes a pick-up roller (102) arranged adjacent to a fixed feed roller (106). The pick-up roller (102) facilitates the picking up of a print receiving media and introducing it to the printing or scanning apparatus. The pick-up roller (102) is generally biased toward the print receiving media by a spring (108) that applies a constant biasing force on the pick-up roller (102).

The biasing force supplied by the spring (108) is usually selected to effectively pick up the single most common media type used by the printing or scanning apparatus. While this typical feed mechanism (100) arrangement works fairly well for the intended media type, when media types other than the primary media type are used, too little force by the spring (108) can cause a misfeed due to the inability to slide the top sheet from the tray or stack. Alternatively, excessive force by the spring (108) causes a misfeed due to multiple sheets sliding from the media tray or stack. In either case, the efficiency of the printing process is significantly reduced.

SUMMARY

A media feed system includes a roller and a selectively adjustable biasing system operatively connected to the roller, wherein the adjustable biasing system includes a spring coupled to an adjustable mount, the mount being movable to compress or decompress the spring.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

An adjustable media feed system that may be used, for example, to feed media into printing, scanning, and/or sorting apparatuses is described herein. More specifically, an apparatus and a method for selectively adjusting the bias force acting on a media feed system are described. For ease of explanation only, the present apparatus and method will be described in the context of a stand alone printer. However, the present apparatus and method may be incorporated into any machine that includes a media feed system including, but in no way limited to, scanners, copiers, facsimile machines, printers, sorters, mailers, and the like. Moreover, the present apparatus and method are described in the context of a print-feed roller, however, the same apparatus and method may be applied to any feed component of a media feed system including, but in no way limited to a retarding or separation roller.

The terms "pick roller" or "pick-up roller" are meant to be understood both here and in the appended claims as being used broadly to encompass any roller or other mechanism that may be used to pick or transport media from a media stack and introduce it into a machine. A "pick roller" or "pick-up roller" is not necessarily circular, and the use of the term in the singular may also encompass a plurality of rollers. Moreover, "media" refers to any material, document, page, or object that may be picked by the "pick roller" and introduced into a machine.

As mentioned above, media feed mechanisms may be found on many document handling machines and are usually tuned to pick up a specific type of likely used media. While tuning the media feed mechanism to the most often used media type is usually effective for picking the specific media type intended, pick-up performance for alternative media types is significantly compromised. Moreover, the tuning of conventional feed mechanisms is not readily adjustable by the user. Therefore, while document handling machines may in theory be capable of scanning, producing, sorting, or reproducing many media types, variations from a specific media type may require hand-feeding or may not be feasible at all. A method and apparatus for adjusting pick roller force to facilitate the reliable use of a single feed mechanism for many different media types is described below. The methods and apparatus described below may be implemented with any machine that uses a feed mechanism. The particular implementations described below are therefore exemplary in nature, and not limiting.

Figure 2:
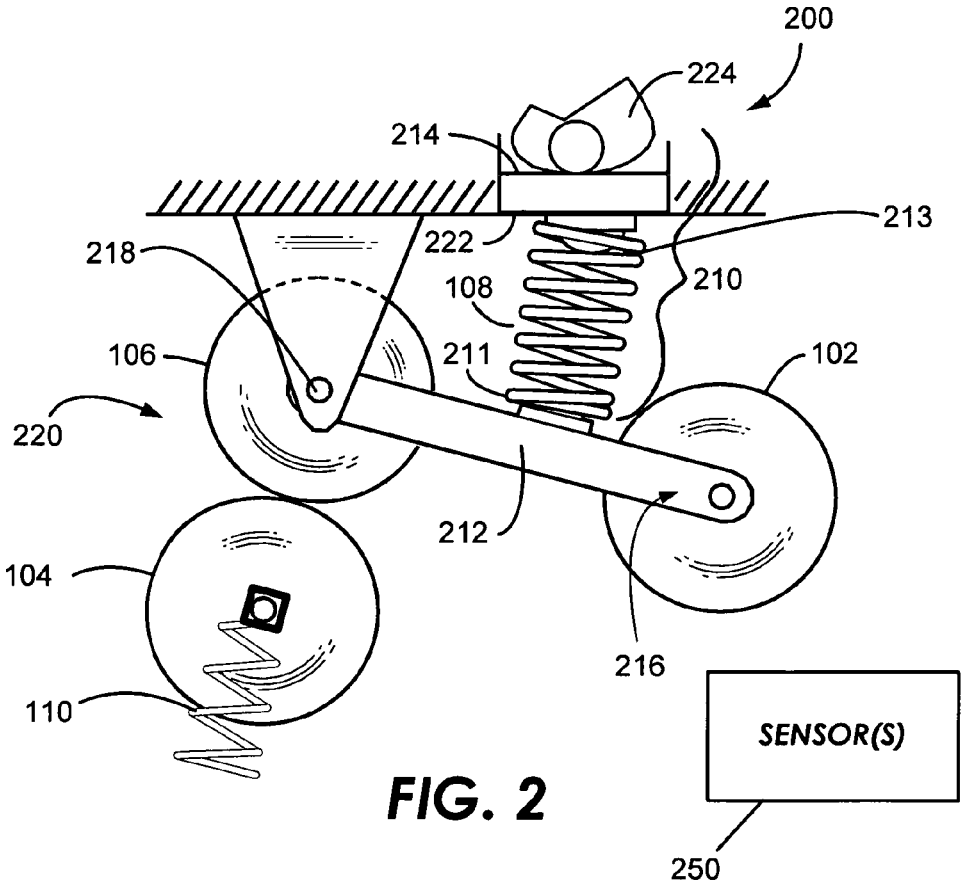
FIG. 2 is a simplified side view of a media feed mechanism with a selectively adjustable biasing system operatively connected to a pick roller according to one exemplary embodiment.

Turning now to FIG. 2, an exemplary embodiment of an adjustable media feed system (200) is illustrated. As shown in FIG. 2, a media feed system may include a pick roller (102) disposed on a first end of a lever arm (212), both a pivot (218) and a fixed feed roller (106) disposed on a second end (220) of the lever arm (212), and a selectively adjustable biasing system (210) operatively connected to the pick roller (102). The selectively adjustable biasing system (210) may include a biasing member, such as a spring (108) having first and second ends (211, 213) disposed between the lever arm (212) and an adjustable mount (214). The adjustable mount (214) may be configured to provide a movable surface (222) that may be displaced to compress decompress the spring (108) and therefore change the preset biasing force applied by the spring (108) to the lever arm (212) and subsequently to the pick roller (102). The operative connection between the biasing spring (108) and the pick roller (102) may either be direct or indirect as illustrated in FIG. 2. A retarding or separation roller (104) having its own biasing spring (110) is also illustrated in FIG. 2 being disposed adjacent to the fixed feed roller (106). The methods and principles explained herein with reference to the pick roller (102) may also be applied to a retarding or separation roller (104).

Distinguishing from conventional document feed systems, the adjustable biasing system (210) of FIG. 2 provides a biasing force that may be changed between at least two different force settings to more reliably transport various media types. A change of the biasing force exerted by the spring (108) may be facilitated, for example, by translation of the adjustable mount (214). The adjustable mount (214) provides a movable surface (222) that may be displaced to compress or decompress the spring (108). This controlled compression and decompression of the spring (108) may change the biasing force applied by the spring (108) to the lever arm (212) and subsequently to the pick roller (102). The movement of the adjustable mount (214) may be facilitated by a rotatable cam (224) disposed adjacent to the adjustable mount (214) as illustrated in FIG. 2. The adjustable mount (214) and the rotatable cam (224) are further explained below with reference to FIG. 3.

Figure 3:
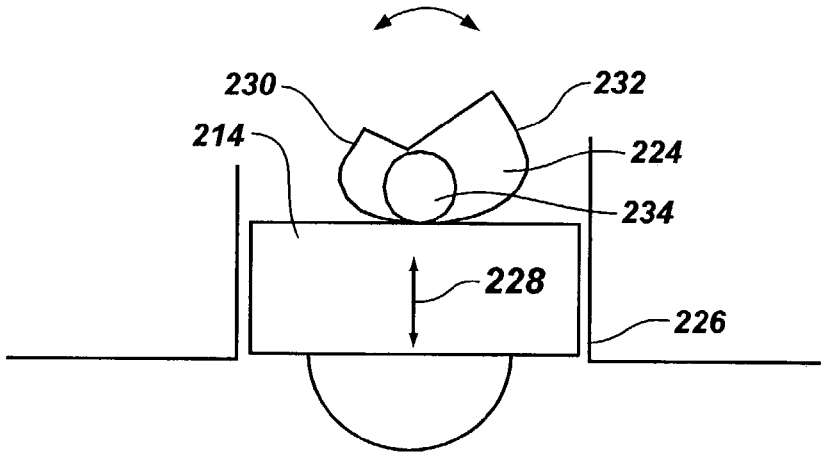
FIG. 3 is a side view illustrating a rotatable cam of a selectively adjustable biasing system according to one exemplary embodiment.

As shown in FIG. 3, the adjustable mount (214) may be housed within a guide (226) that limits movement of the adjustable mount (214) to a single degree of freedom. The single degree of freedom is represented in FIG. 3 by a directional arrow (228). As a consequence of the movement limitations imposed by the guide (226), rotation of the adjacent cam (224) may cause the adjustable mount (214) to move within the guide (226) such that it compresses or decompresses the spring (208; FIG. 2), depending on the direction of rotation and position of the cam (224). While the cam (224) illustrated in FIG. 3 has two lobes including a first lobe (230) and a second lobe (232), the cam (224) is in no way limited to a cam with a plurality of lobes. Rather, cams of any size, shape, number of lobes, or having variable surfaces capable of translating the adjustable mount (214) may be incorporated by the present system and apparatus.

Referring again to FIG. 2, engagement of the cam (224) with the adjustable mount (214) may be tuned with the spring (208) or other biasing member to create an optimal force for picking up one or more media types. For example, the combination of the spring (208), the adjustable member (214), and the first lobe (232; FIG. 3) of the cam (224) may be tuned to provide an optimal biasing force to the pick roller (102) for picking paper. Similarly, the second lobe of the cam (230; FIG. 3) in combination with the adjustable mount (214) and the spring (108) may be selectively tuned to provide an optimal biasing force to the pick roller (102) for picking labels. Additional force settings associated with multiple cam lobes or cam positions may also be facilitated in like manner to accommodate additional media types.

Figure 4:
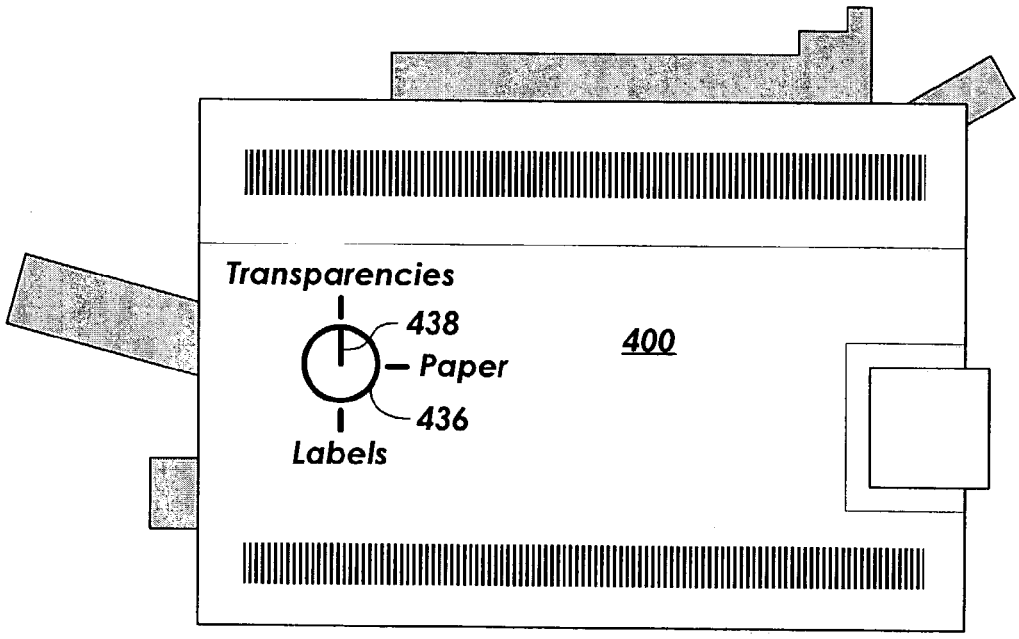
FIG. 4 is a side view of a printer implementing a media feed mechanism according to one exemplary embodiment.

The cam (224) may be mounted on a shaft (234; FIG. 3) that facilitates positional rotation of the cam (224) to predetermined positions. In addition, the shaft (234; FIG. 3) may be coupled to a dial (436, FIG. 4) or a lever accessible to a user as shown in FIG. 4. According to the exemplary embodiment illustrated in FIG. 4, a dial (436) may be integrated with a printer (400) or other apparatus utilizing a media feed mechanism such as those mentioned above. The dial (436) may include an indicator (438) that designates what type of media the adjustable biasing system (210; FIG. 2) is calibrated to. As shown in FIG. 4, the indicator (438) may have two or more different settings, such as the "Transparencies," "Paper," or "Labels" settings illustrated in FIG. 4. As shown in FIG. 4, the dial (436) is set to a "Transparencies" setting which corresponds with a preset biasing force optimal for transporting plastic transparencies.

While FIG. 4 illustrates the use of a dial (436) to manipulate the rotational position of the cam (224; FIG. 2), the dial may be replaced by a number of manipulation devices including, but in no way limited to, a motor, a lever, or a solenoid configured to rotate the cam (224, FIG. 2) and adjust the biasing force of the spring. The motor, lever, or solenoid may be operated by a manual controller on a printer (400), by a processor that forms an integral part of a printer (not shown), or it may be controlled by a computer (not shown) in a networked configuration with the printer (400) as described below with reference to FIGS. 10 and 11.

Figure 5:
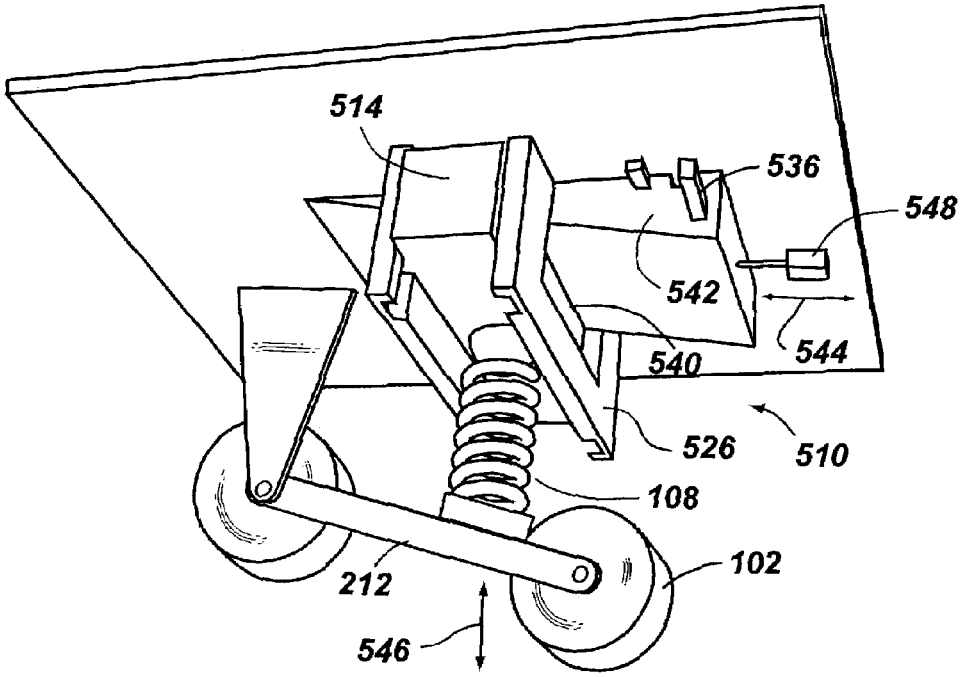
FIG. 5 is a perspective view of a media feed mechanism with a selectively adjustable biasing system implementing a movable wedge according to one exemplary embodiment.

Referring now to FIG. 5, an alternative method for providing a selectively adjustable biasing system (510) is shown. As with the embodiment illustrated in FIG. 2, the selectively adjustable biasing system (510) illustrated in FIG. 5 includes a spring (108) or other biasing member operatively connected to a pick roller (102) configured to impart an adjustable biasing force directly or indirectly to the pick roller (102). Also similar to FIG. 2, the spring (108) is disposed between the lever arm (212) and an adjustable mount (514). However, unlike the adjustable mount (214; FIG. 2) illustrated in FIG. 2, the adjustable mount (514) illustrated in FIG. 5 includes an angled surface (540) engaging an adjacent movable wedge (542) that is disposed transverse to the adjustable mount (514).

The movable wedge (542) illustrated in FIG. 5 may be limited to a single degree of freedom, indicated by a generally horizontal arrow (544), thereby providing at least two different force settings to the spring (108). The adjustable mount (514) may also be limited to a single degree of freedom by a guide (526) that limits movement of the adjustable mount (514) to the directions indicated by a generally vertical arrow (546). Consequently, as the movable wedge (542) is translated laterally, the adjustable mount (514) traverses the wedge and is forced by the guide (526) to translate in a direction normal to the lateral movement of the movable wedge (542). The linear movement of the adjustable mount (514), indicated by the vertical arrow (546), will depend on the direction of movement by the wedge (542). When the moveable wedge (542) translates from right to left (as shown in FIG. 5), the adjustable mount (514) moves toward the lever arm (212), compressing the spring (108), and adding to the force applied by the pick roller (102). Alternatively, when the moveable wedge (542) translates from left to right (as shown in FIG. 5), the adjustable mount moves away from the lever arm (212), reducing the compression of the spring (108), and reducing the force applied by the pick roller (102).

Translation of the moveable wedge (542) may be accomplished by any mechanical means capable of controllably translating the wedge including, but in no way limited to, a manual adjusting lever (536), a motor (not shown), or a manual or electrically controlled solenoid (548). If a manual adjusting lever (536) is coupled to the moveable wedge (542), a user may adjust the force applied by the pick roller (102) by simply adjusting the position of the manual adjusting lever (536).

Figure 6:
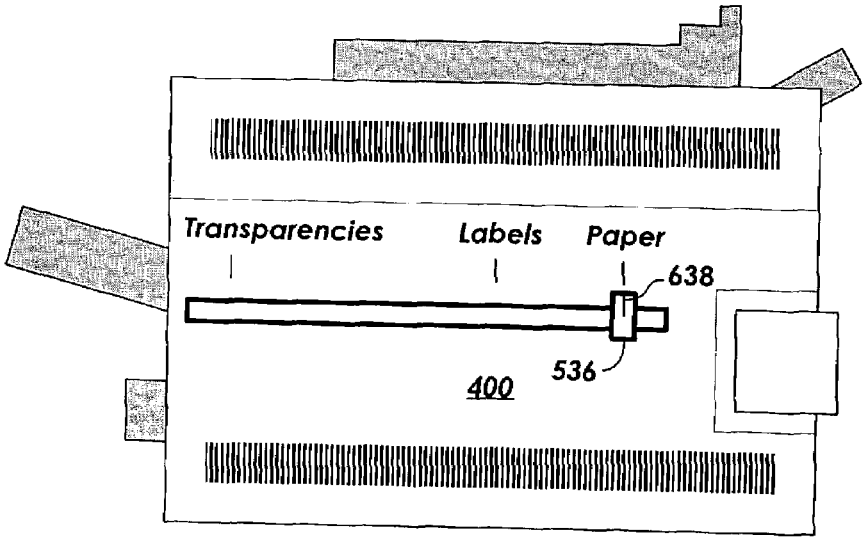
FIG. 6 is a side view of a printer implementing a media feed mechanism according to one exemplary embodiment.

FIG. 6 illustrates a printer incorporating a manual adjusting lever (536) as the means of translating the moveable wedge (542; FIG. 5) and adjusting the force applied to the pick roller (102; FIG. 5) by the spring (108; FIG. 5). As shown in FIG. 6, the lever (536) may include an indicator (638) for precisely adjusting the force applied to the pick roller (102; FIG. 5). Similar to the indicator (438; FIG. 4) of FIG. 4, the indicator (638) of FIG. 6 may be used to designate what media the adjustable biasing system (510, FIG. 5) is calibrated to. As shown in FIG. 6, the indicator (638) may include multiple settings, such as the "Transparencies," "Paper," or "Labels" settings shown. FIG. 6 illustrates the lever (536) being set to "Paper," which corresponds with a moveable wedge (542, FIG. 5) positioned such that the biasing force applied to the pick roller (102; FIG. 5) is selectively tuned for picking paper.

Figure 7:
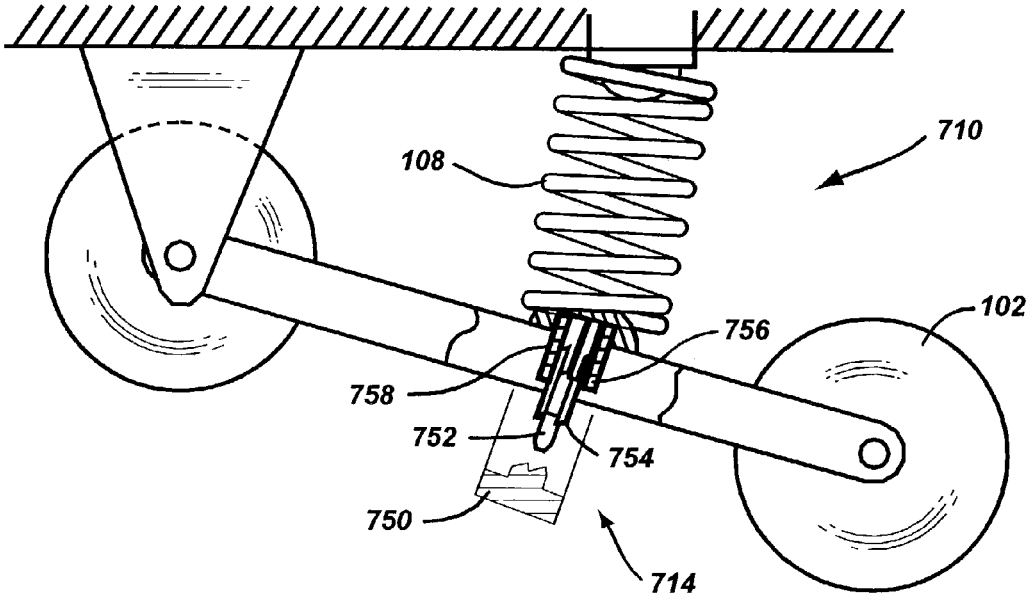
FIG. 7 is a simplified side view of a media feed mechanism with a selectively adjustable biasing system implementing a push button switch according to one exemplary embodiment.

FIG. 7 illustrates yet another exemplary embodiment of a selectively adjustable biasing system (710). As shown in FIG. 7, a push button switch (714) may be coupled to the bias force supplying spring (108) to serve as an adjustable mount. The push button switch (714) illustrated in FIG. 7 works similarly to a push button switch of a conventional "clicker pen." A depression of a button (750) causes a first shaft (752) having one or more protrusions (754) to rotate and engage a number of mating protrusions (756) located around a second shaft (758) concentric with the first shaft (752). The protrusions (754) located around the second shaft (758) are arranged in various axial positions along the second shaft (758) such that each depression of the button (750) toggles the effective length of the first shaft (752) adjusting the biasing force of the spring (108) applied to the pick roller (102). The position of the protrusions (756) located around the second shaft (758) may alternate in pairs, similar to a typical "clicker pen," to facilitate two different force settings. Alternatively, the position of the protrusions (756) may be arranged axially such that three or more force settings are available.

Figure 8:
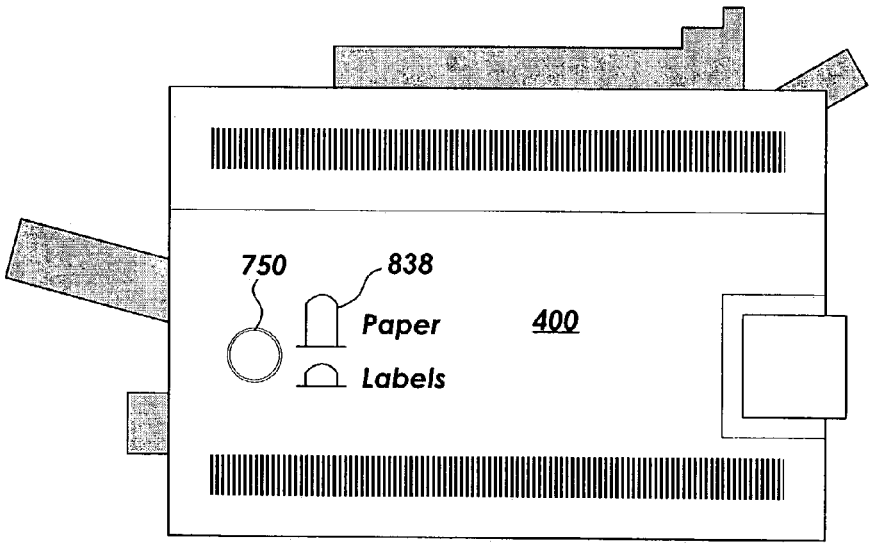
FIG. 8 is a side view of a printer implementing a media feed mechanism according to one exemplary embodiment.

FIG. 8 illustrates an exemplary printer (400) incorporating the selectively adjustable biasing system (710; FIG. 7) shown in FIG. 7. As shown in FIG. 8, an indicator (838) may be disposed on the printer (400) indicating the position of the push button switch (714; FIG. 7). When the button (750) is pressed, changing the position of the push button switch (714; FIG. 7), the indicator (838) may also change to inform the user of the selected push button position. The indicator (838) may also include media indicating settings, as shown in FIG. 8, indicating what media the adjustable biasing system (710, FIG. 7) is calibrated to.

Figure 9:
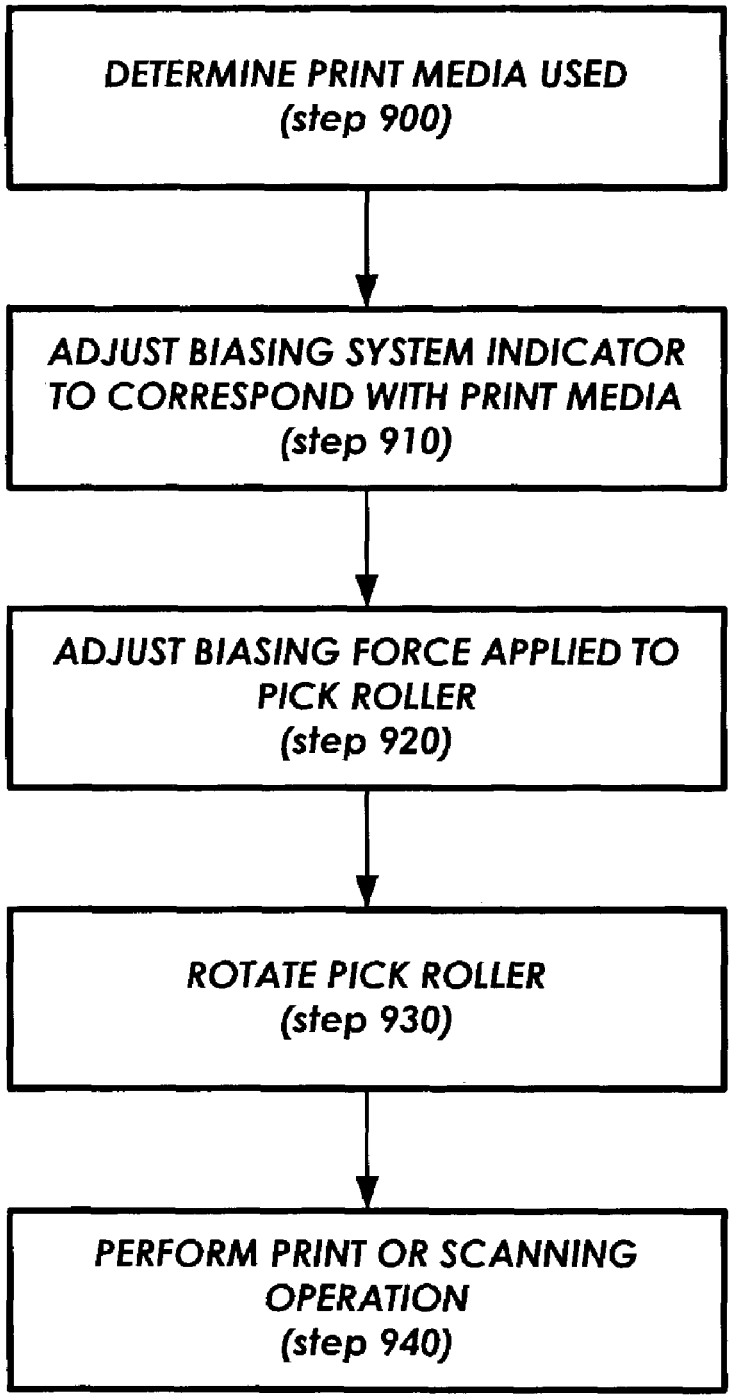
FIG. 9 is a flow chart illustrating a method of adjusting a pick roller biasing force to correspond with a desired media according to one exemplary embodiment.

FIG. 9 illustrates a method for incorporating the various adjustable bias systems described above. As shown in FIG. 9, the present adjustable bias systems may be employed by first determining the print media to be used (step 900), adjusting the biasing system indicator to correspond with the print media being used (step 910), adjusting the biasing force applied to the pick roller (step 920), rotating the pick roller once there is a change in biasing force (step 930), and performing the desired print or scanning operation (step 940).

The incorporation of an adjustable bias system begins by the user determining what type of print media needs to be picked by the pick roller (step 900). Once the user has determined the type of print media to be used, the bias system indicator may be adjusted to correspond with the selected print media (step 910). The setting selected by the user may either be a predetermined setting indicated by a label or other indicator on the printer corresponding to different types of print media, or the setting selected may be fine tuned by the user across a wide range of settings depending on the type of indicator employed. The predetermined settings that may be chosen by the user may include, but are in no way limited to, settings for transparencies, labels, various paper weights, various paper coatings, and various paper sizes. The adjusting of the bias indicator may be accomplished, as explained above, by turning a dial (e.g. 436, FIG. 4), manipulating a lever (e.g. 536, FIG. 6), depressing a button (e.g. 750, FIG. 8), or any other sufficient method.

When the indicator is adjusted to correspond with the print media chosen, the bias force applied to the pick roller (102; FIG. 2) is adjusted accordingly (step 920). One way, explained above, of adjusting pick roller preload tension is to move an adjustable mount (e.g. 214, FIG. 2) toward or away from a biasing member (e.g. 108, FIG. 2). The adjustable mount may be attached to the biasing member, such that moving the adjustable mount changes the force applied by the biasing member. According to one method, the adjustable mount is moved by rotating a cam (e.g. 224, FIG. 2) disposed adjacent to the adjustable mount. Alternatively, a sliding a wedge (e.g. 542, FIG. 5) may be moved into or out of engagement with the adjustable mount, a locking button may be pressed (e.g. 750; FIG. 8), or any number of additional or alternative methods may be used to move the adjustable mount (e.g. 214, FIG. 2).

With the pick roller (e.g. 214, FIG. 2) applying the correct bias force to the desired print media, the pick roller may be rotated (step 930) and the print or scanning operation may be performed (step 940) on the desired print media. The rotation of the pick roller advances a single print media from a media stack (not shown) to subsequent printing locations in the printer or other apparatus. As the print media is advanced to printing or scanning locations in the printer or other apparatus, the print or scanning process may be performed on the desired print media.

Further, principles described herein may be used to modify a printing or scanning apparatus to enhance picking of various media types. A method of modifying a printing or scanning apparatus may include, for example, adding a mechanical system having multiple settings for changing a downward force applied by a pick roller to the various media types. Examples of such mechanical systems are described above with reference to FIGS. 2-8. The method may further include rotating a dial (e.g. 436, FIG. 4), moving a lever (e.g. 536, FIG. 6), or depressing a button (e.g. 750, FIG. 8) of the mechanical system to select between settings for the various media types. As described above, mechanical systems according to principles described herein may include a movable surface (e.g. 222, FIG. 2) attached to a biasing member (e.g. 108, FIG. 2). The movable surface may be displaced to adjust the compression of the biasing member. The movable surface may be displaced in response to rotation of an adjacent cam, transverse movement of an adjacent wedge, depression of a locking button, or other means. Additional methods and apparatus for adjusting media feed systems may also be implemented according to the principles described herein.

Alternative Embodiments

Figure 10:
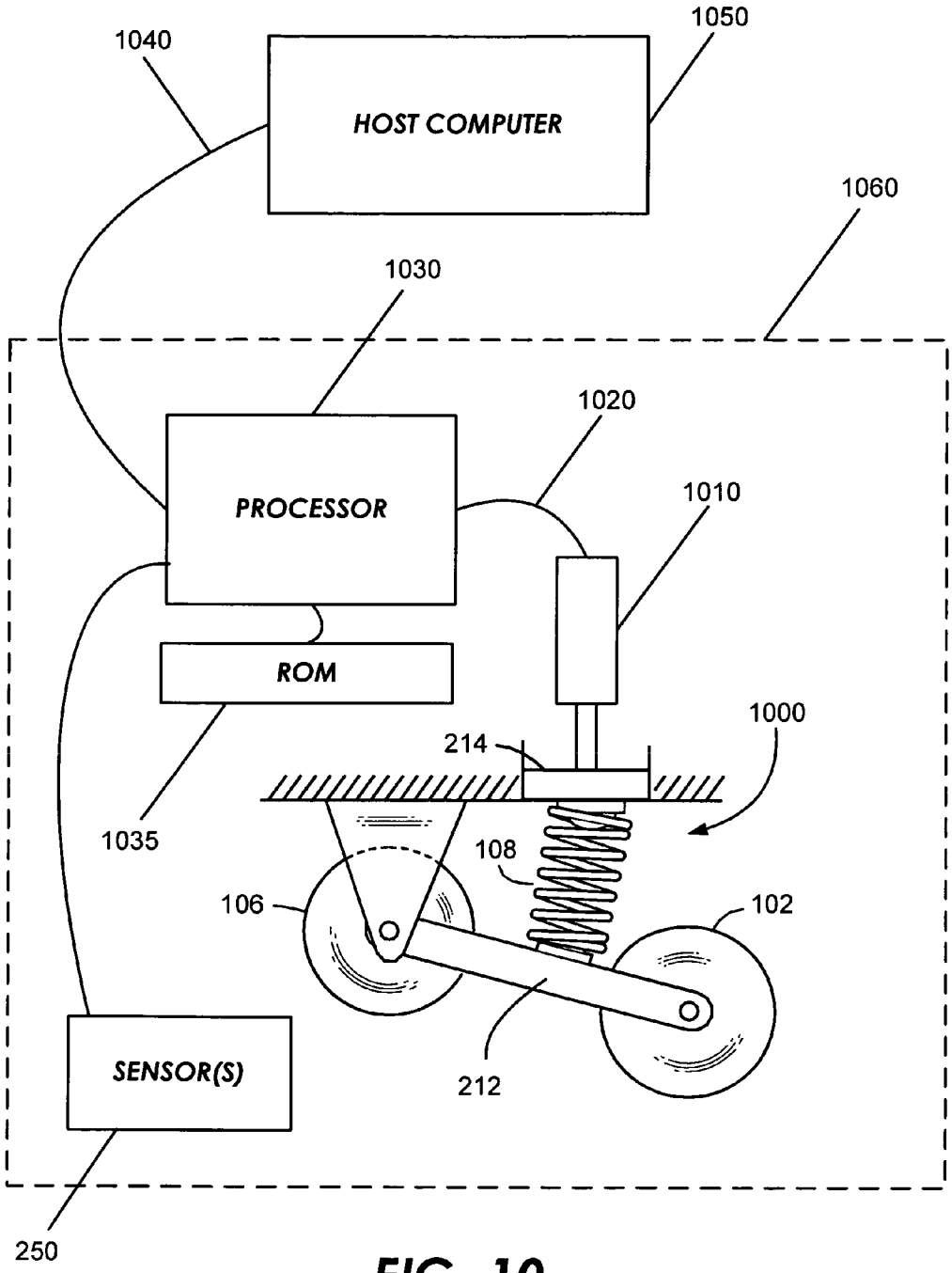
FIG. 10 is a block diagram illustrating the components of an automated adjustable pick roller biasing force system according to an alternative embodiment.

FIG. 10 illustrates an automated adjustable pick roller biasing force system according to an alternative embodiment. As shown in FIG. 10, a printing device (1060) may include a pick roller (102) disposed on a first end of a lever arm (212), a fixed feed roller (106) dispose on a second end of the lever arm (212), and a selectively adjustable biasing system (1000) operatively connected to the pick roller (102). The selectively adjustable biasing system (1000) may include an adjustable mount (214) movably coupled to a solenoid (1010). Additionally, the solenoid (1010) may be controllably coupled to a processor (1030) through a communications cable (1020). The processor (1030) of the printing device (1060) may, in turn, be communicatively coupled to a host computer (1050) through a communications path (1040).

The selectively adjustable biasing system (1000) of the exemplary embodiment illustrated in FIG. 10 is similar to the selectively adjustable biasing systems explained above in FIGS. 2-8, with the addition of the processor (1030) and read only memory (ROM) (1035) being controllably coupled to the solenoid (1010). While a solenoid (1010) is illustrated as being connected to the adjustable mount (214) in FIG. 10, any controllable actuator with at least two potential positions may be implemented in place of the solenoid (1010) including, but in no way limited to, a motor and a cam system, a solenoid and a moveable wedge system, or a push button system as explained above. Moreover, the processor (1030) illustrated in FIG. 10 may be any signal processing device capable of receiving an input signal from a user interface and converting the signal, with the aid of firmware contained in the ROM (1035), into a positional signal for the controllable actuator (1010) including, but in no way limited to, an application-specific integrated circuit (ASIC) or other integrated circuit.

As shown in FIG. 10, a host computer (1050) may be communicatively coupled to the processor (1030) of the printing device (1060) through a communications path (1040) in order to provide the processor with bias specific signals corresponding to desired media. The communications path (1040) communicatively coupling the host computer (1050) to the processor (1030) may be any communications path capable of sending a print job and bias specific signals from a driver of the host computer (1050) to the printing device (1060) including, but in no way limited to, a universal serial bus (USB) cable, wireless transmission systems, an Ethernet system, or the Internet. Alternatively, the host computer (1050) and the communications path (1040) may be eliminated from FIG. 10. According to the embodiment that eliminates the host computer (1050) and the communications path (1040), the user may enter bias specific information related to a desired print media directly to the processor (1030) through a graphical user interface (GUI) or other user interface that may be located directly on the printing device (1060).

Figure 1:
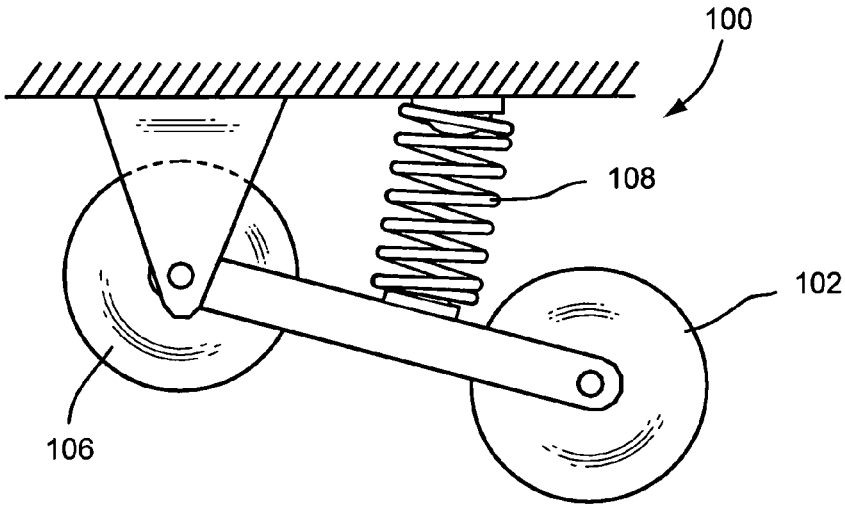
FIG. 1 (Prior Art)
FIG. 1 is a simplified side view of a document media feed mechanism according to the prior art.
Figure 11:
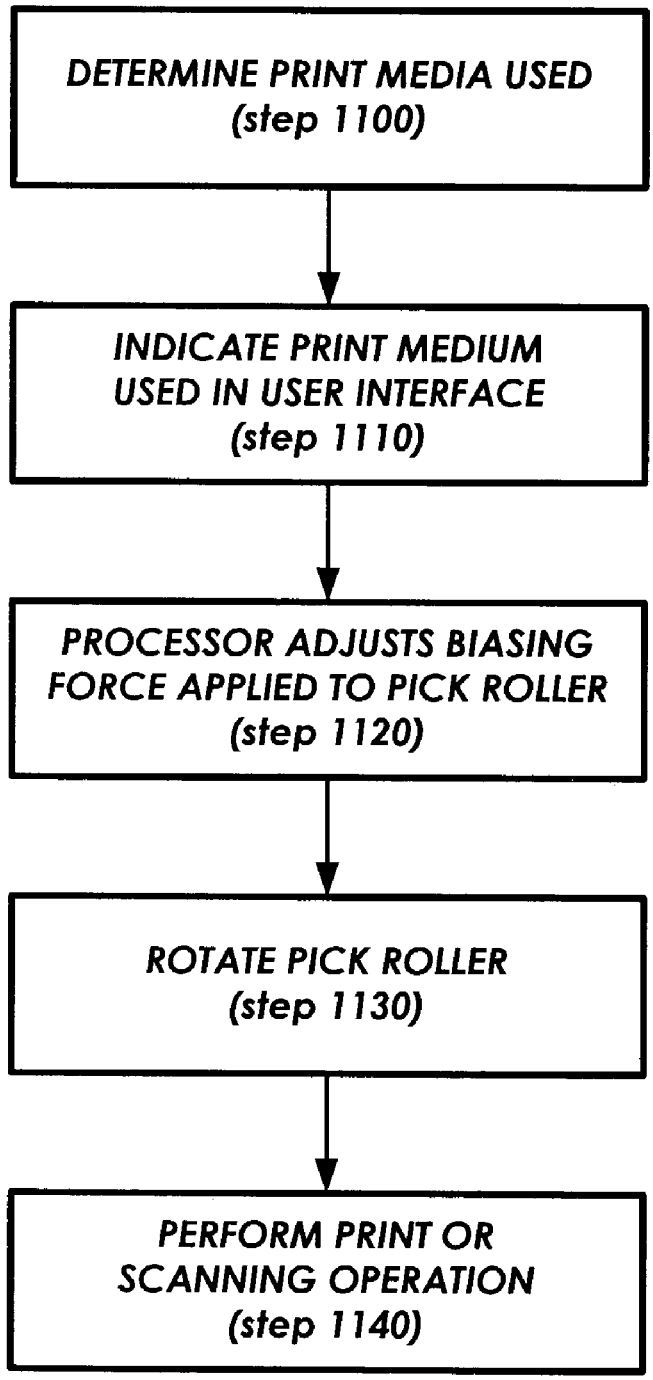
FIG. 11 is a flow chart illustrating a method for using an automated adjustable pick roller biasing force system according to one exemplary alternative embodiment.

FIG. 11 illustrates an exemplary method for the implementation of the automated adjustable pick roller biasing force system. As shown in FIG. 1, the process begins when a user determines what type of print media to use in the printing apparatus (step 1100). Once the print media has been determined, the user may indicate their selection on the user interface (step 1110) which subsequently transmits the media selection information to the processor of the printing device where the printing device adjusts the biasing force applied to the pick roller (step 1120), the pick roller is rotated (step 1130), and the printing device performs the desired printing or scanning operation (step 1140) on the desired print media.

As explained above, the user must determine what type of print media to use in the printing apparatus (step 1100). The selection of print media may be from a standardized list of available print media currently accessible in the printing device (1060; FIG. 10), or the selection may be made from any print media available to the user. When the print media has been selected, the user may indicate the selection on the user interface (step 1110). The indication of the print media by the user may be performed by the user inserting a numeric value in a field on a user interface of the host computer (1050; FIG. 10) that corresponds to a biasing force, or alternatively, the user may select a description of the desired print media from a pull down menu or other display list. The pull down menu or other display list will have pre-programmed biasing force settings corresponding to each available print media.

Once the desired print media has been indicated on a user interface (either a host computer (1050; FIG. 10) or a user interface that forms an integral part of the printing device (1060; FIG. 10)), a signal corresponding to the selected biasing force setting is transmitted to the processor (1030; FIG. 10) of the printing device (1060; FIG. 10) that adjusts the biasing force applied to the pick roller (step 1120). When the processor (1030; FIG. 10) receives the desired biasing force setting, it accesses firmware stored in the RAM (1035; FIG. 10) and converts the requested biasing force signal into a control signal used to manipulate the controllable actuator (1010; FIG. 10) accordingly. If an increased biasing force is required, the processor (1030; FIG. 10) causes the controllable actuator to translate the adjustable mount (214; FIG. 10) such that it increases the biasing force as explained above in the context of the previous embodiments. Similarly, if a reduction in the biasing force is requested by the processor (1030; FIG. 10), a signal is transmitted to the controllable actuator causing it to translate the adjustable mount in such a manner that the biasing force is reduced.

Once the biasing force has been adjusted to correspond with the selected print media, the pick roller (102; FIG. 10) may be rotated (step 1130) causing the feed of the desired print media into the printing device (1060; FIG. 10). As the desired print media is introduced into the printing device (1060; FIG. 10), the printing device may perform the desired print or scanning operation (step 1140) without jams or misfeeds.

The embodiment illustrated in FIG. 10 may also incorporate a number of sensors (250) configured to detect jams or misfeeds. If a jam is detected by the sensors, too much biasing force may be exerted on the pick roller (102; FIG. 10) causing the simultaneous picking of multiple media. Once detected, the processor (1030; FIG. 10) may send a signal to the actuator (1010; FIG. 10) causing it to reduce the biasing force. Similarly, if a misfeed is detected by the sensors, the processor may increase the biasing force to enable the picking of the desired media.

In conclusion, the present adjustable pick roller force system and method effectively reduces the likelihood of media jams or misfeeds by controllably adjusting the biasing force applied to a pick roller or separation roller. More specifically, the present system and method permit the use of a moveable platform to adjust the biasing force applied to a pick roller to correspond with different types of media. This method and system increase the efficiency of printing and scanning apparatuses by greatly reducing the likelihood of costly jams or misfeeds.

The preceding description has been presented only to illustrate and describe embodiments of invention. It is not intended to be exhaustive or to limit the invention to any precise form disclosed. Many modifications and variations are possible in light of the above teaching. It is intended that the scope of the invention be defined by the following claims.

What is claimed is:

1. A media feed system comprising:

a pick-up roller; and a selectively adjustable biasing system operatively coupled to said roller for controlling an amount of force applied by said roller;

wherein said adjustable biasing system includes a spring coupled to said roller and to an adjustable mount, said mount being movable to compress or decompress said spring to adjust said force applied by said roller;

wherein said adjustable mount is disposed adjacent to a rotatable cam such that rotation of said rotatable cam causes said adjustable mount to move and vary, motion of said adjustable mount varying a force applied by said spring to said roller; and wherein said rotatable cam is operatively connected to a lever or a dial, said lever or dial being configured to rotate said cam.

2. A media feed system comprising:

a pick-up roller; and a selectively adjustable biasing system operatively coupled to said roller for controlling an amount of force applied by said roller;

wherein said adjustable biasing system includes a spring coupled to said roller and to an adjustable mount, said mount being movable to compress or decompress said spring to adjust said force applied by said roller;

wherein said adjustable mount is disposed adjacent to a movable wedge, wherein movement of said movable wedge causes a linear translation of said adjustable mount in a direction normal to said movement; and further comprising a dial or a lever operatively connected to said wedge, wherein said dial or lever is configured to laterally move said wedge.

3. The system of claim 1, wherein said system further comprises a separation roller, in addition to said pick-up roller, said separation roller being biased into position by a second spring.

4. The system of claim 1, wherein said roller is supported on an arm that pivots about a fixed point, said spring being coupled to said arm.

5. The system of claim 4, wherein said arm is coupled to and extends from a fixed feed roller.

6. The system of claim 1, further comprising a processor controllably coupled to said adjustable biasing system, wherein said adjustable biasing system is configured to adjust in response to a signal from said processor.

7. The system of claim 6, further comprising at least one sensor configured to sense a print medium misfeed or jam, wherein said processor is configured to adjust said biasing system in response to output from said at least one sensor.

8. The system of claim 2, wherein said system further comprises a separation roller, in addition to said pick-up roller, said separation roller being biased into position by a second spring.

9. The system of claim 2, wherein said roller is supported on an arm that pivots about a fixed point, said spring being coupled to said arm.

10. The system of claim 9, wherein said arm is coupled to and extends from a fixed feed roller.

11. The system of claim 2, further comprising a processor controllably coupled to said adjustable biasing system, wherein said adjustable biasing system is configured to adjust in response to a signal from said processor.

12. The system of claim 11, further comprising at least one sensor configured to sense a print medium misfeed or jam, wherein said processor is configured to adjust said biasing system in response to output from said at least one sensor.

* * * * *